US007159943B2

(12) United States Patent
Costaglia

(10) Patent No.: US 7,159,943 B2
(45) Date of Patent: Jan. 9, 2007

(54) ADJUSTABLE OFFICE ARM CHAIR STRUCTURE WITH ARTICULATION FOR THE SYNCHRONOUS MOVEMENT OF THE SEAT AND THE BACKREST

(75) Inventor: Massimo Costaglia, Galliera Veneta (IT)

(73) Assignee: Metalseat Srl, Galliera Veneta (IT)

( * ) Notice: Subject to any disclaimer, the term of this patent is extended or adjusted under 35 U.S.C. 154(b) by 223 days.

(21) Appl. No.: 10/831,584

(22) Filed: Apr. 23, 2004

(65) Prior Publication Data

US 2005/0264071 A1 Dec. 1, 2005

(51) Int. Cl.
*A47C 1/024* (2006.01)

(52) U.S. Cl. ..... 297/323; 297/316; 297/301.4; 297/301.5

(58) Field of Classification Search ..... 297/316, 297/323, 301.4, 301.5, 301.6, 301.7
See application file for complete search history.

(56) References Cited

U.S. PATENT DOCUMENTS 4,986,601 A 1/1991 Inoue
5,725,276 A * 3/1998 Ginat ..... 297/323 X
6,709,058 B1 * 3/2004 Diffrient ..... 297/316 X

FOREIGN PATENT DOCUMENTS

| | | |
|---|---|---|
| DE | 0198056 | 0/0000 |
| FR | 2075176 | 8/1971 |
| IT | 01236439 | 12/1989 |
| IT | TV20000084 | 1/2002 |

* cited by examiner

*Primary Examiner*—Anthony D. Barfield
(74) *Attorney, Agent, or Firm*—Egbert Law Offices

(57) ABSTRACT

A structure for an office chair with articulation by synchronized movement of the seat and the backrest of the adjustable type includes a swivel type movable base with a height adjustable column supporting a seat surface and a reciprocally hinged backrest. The seat surface is connected frontally by two braces to the corresponding anterior side of a central support body anchored on the top of the adjustable column along the vertical axis. The central support body supports with hinges the lower ends of two arm-rest stanchions provided with a device for the adjustment of the height of the seat and with an locking-unlocking device for the oscillation of the backrest and the chair. The frame of the backrest is hinged along the sides and in correspondence with the posterior part of the seat. A compressed spring is interposed between the central support body and the support frame of the backrest.

5 Claims, 4 Drawing Sheets

ADJUSTABLE OFFICE ARM CHAIR STRUCTURE WITH ARTICULATION FOR THE SYNCHRONOUS MOVEMENT OF THE SEAT AND THE BACKREST

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention refers to an adjustable office arm-chair structure with articulation for the synchronized movement of the seat and the backrest.

The proposal finds particular if not exclusive application in the field of quality seats for office furniture.

BACKGROUND OF THE INVENTION

Adjustable office seats and arm-chairs are certainly known. To allow a more comfortable seat with reference to those of lower quality of the static type, they provide, in addition to a device to adjust the height, the use of a device for controlled oscillation, usually positioned in the part immediately below the surface of the seat and integral with it. Said device can further be actuated by means of a lever, which projects and can be easily gripped and thus rotated in one direction then in the other, until the internal device does not provide the unlocking of the articulation.

Briefly, it is therefore possible to affirm that the following are known:

- chairs in which the seat and the backrest are on separate bodies, the two being connected in such a way that an inclination of the backrest corresponds to a movement parallel to the ground of the seat;
- chairs in which the backrest is exclusively free to oscillate;
- chairs in which the lifting of the seat surface corresponds to the inclination of the backrest;
- chairs in which both the seat and the backrest are individually adjustable;
- finally, chairs where both the seat and the backrest, being interconnected, carry out a synchronized inclination movement.

PRIOR ART RELATIVE TO THE INVENTION

For example a first dynamic device for chairs is described in FR2075176 (Suspa) that provides a base provided with a plurality of support arms, from which a stanchion is erected, made up of a gas cylinder. The end of said gas cylinder, from which the button to operate the piston projects, is introduced into the interior of a truncated conical-shaped hole monolithically obtained from the box-like containment structure of the device.

More significant is U.S. Pat. No. 4,986,601 (Inoue), which mentions an oscillating mechanism to support a chair and the backrest of a chair, comprising a central column that extends from the base of the chair, a first support bracket connected to the central column by a pedestal, a second support bracket connectable to the seat and hinged to the first support bracket by an axis, a third support bracket connected to the posterior support and hinged by an axis to the second support bracket, and an axis hinging the first support bracket to the third support bracket. U.S. Pat. No. 4,986,601 (Inoue) also provides a gas piston with a valve that can be actuated by a rod, positioned in the central column to selectively adjust the height of the column. And finally, U.S. Pat. No. 4,986,601 (Inoue) also provides spring means positioned between the first and second bracket to exert an opposing force on the second support bracket.

DE0198056 (Neumuller) is also interesting. This shows an oscillating mechanism to support the seat surface and the backrest of a chair, comprising a central column that extends from the base of the chair, a first support bracket connected to the central column, a second support bracket connectable to the seat surface and pivoted to the first bracket by a first pivot, a third support bracket connected to the backrest and hinged to the second support bracket by a second pivot, as well as means that pivot the first support bracket to the third support bracket. DE0198056 (Neumuller), also provides spring means positioned between the first and second support bracket, to exert an opposing force on the movement of the second bracket. DE0198056 (Neumuller) also disposes of locking means, comprising a third pivot connected to the first bracket and a fourth pivot connected to the second bracket cooperating with a plurality of discs provided with an elongated slot in which the pivot is of the passing type. A rod associated to the relative pivot allows the frictioned clamping of discs that in this way are held together.

A mechanical device, particularly for the synchronized movement of the seat and the backrest of a chair is also described in IT1236439 (Miotto). The proposal is characterized in that it comprises a first support bracket, associated at the ends to a central column projecting from a rotating base and pivoted transversely at the end of a second fixing bracket to said chair, said second fixing bracket being hinged to the other end, transversely and eccentrically with respect to the axis of said central column, and a third anchorage bracket for said backrest, the latter presenting guiding means for its oscillation with respect to said first and second bracket, with means finally being provided for the selective locking of the mutual position between said first, second and third bracket.

ITTV2000A000084 (Bordin) is also of interest as it describes an ergonomic chair-armchair structure, of the type with an adjustable headrest and lower backrest, comprising a base with relative vertical support column of a seat surface and a backrest, the latter being of the type obtained in a sheet extended between the two sides of the chair-armchair, in which, a support element of the headrest and of the lower backrest, developed according to profile of the backrest in the vicinity of the posterior side of the latter, on one side, being anchored below the seat surface, on the other to a connecting strip between the sides of the chair; and furthermore in which said headrest and lower backrest are adjustable along said support element, providing selective locking means.

DRAWBACKS

In short, it is possible to affirm that the proposals U.S. Pat. No. 4,986,601 (Inoue), DE0198056 (Neumuller) and also IT1236439 (Miotto) of the conceptually very similar solutions due to the interaction of the three brackets, require numerous components that render the chair structure particularly complex. This complexity, in addition to involving significant difficulties and undoubtedly excessive times in the assembly phase, translates into an irrational management of single codes that identify each component in stock.

On the other hand, not even the reduced functionality of the articulation is insignificant, that due to the friction between the single parts, in the opinion of the applicant, would not be sufficiently optimized in conferring to user an improved feeling of softness.

An additional negative aspect refers to the inefficient position of the control levers of the regulating devices for the selective locking-unlocking of the synchronized movement of the seat and the backrest.

In terms of negative aspects, reference can also be made to a limited degree to the position and adjustment of the lumbar-support device for the relaxation of the lumbar region of the back. In this case, in the known solutions, the existing lumbar supports have particularly complex support structures and according to the applicant are impractical.

BRIEF SUMMARY OF THE INVENTION

This and other aims are achieved with this invention, according to the characteristics in the included claims, solving the disclosed problems by means of a structure for an office chair with articulation by means of the synchronized movement of the seat and the backrest of the adjustable type, comprising a swivel type movable base, on this base a column is erected that is height adjustable, that supports a seat surface and a reciprocally hinged backrest, this backrest supports a headrest and a lumbar support that is also adjustable, in which:

- the seat surface is connected frontally by means of two braces to the corresponding anterior side of a central support body anchored on the top of the adjustable column along the vertical axis;
- the central support body, at the back, supports with hinges the lower ends of two arm-rest stanchions provided with a device for the adjustment of the height of the seat and with an locking-unlocking device for the oscillation of the backrest and the chair, said stanchions further being hinged in an position intermediate to the ends of the support frame of the backrest;
- the frame of the backrest is hinged along the sides and in correspondence with the posterior part of the seat;
- a compressed spring is interposed between the central support body and the support frame of the backrest.

ADVANTAGES

In this way, certain objectives are achieved by means of the considerable creative contribution the effect of which constitutes immediate technical progress, all substantially extended to allow the production of a notably softer chair with respect to pre-existing solutions.

The lightening of the chair structure, due to the low number of components, renders said chair, when moved, almost without friction and with a consequent reduction of the noise and reduction of wear on the components.

A second aim consisted in rendering more practical both the adjustment control device for the mutual inclination of the seat and the backrest, as well as the adjustment control device for the height of the seat.

A third aim consists in proposing a chair that offers an optimal position in complete harmony for the prevention of injures, both for the controls for adjusting the mutual inclination of the seat and the backrest as well as for the height of the seat.

A further aim, as a consequence of the reduction of the number of components, it is noticeable that warehouse management is significantly simplified, as are the times and assembly costs.

In conclusion, is it possible to produce a chair structure provided with good technological content that integrates as many functions as possible that can be offered to the public at a reasonably contained cost.

These and others advantages will appear from the following specific description of at least one preferred embodiment with the aid of the enclosed schematic drawings whose details are not to be considered restrictive but only illustrative.

DETAILED DESCRIPTION OF THE INVENTION

Figure 1:
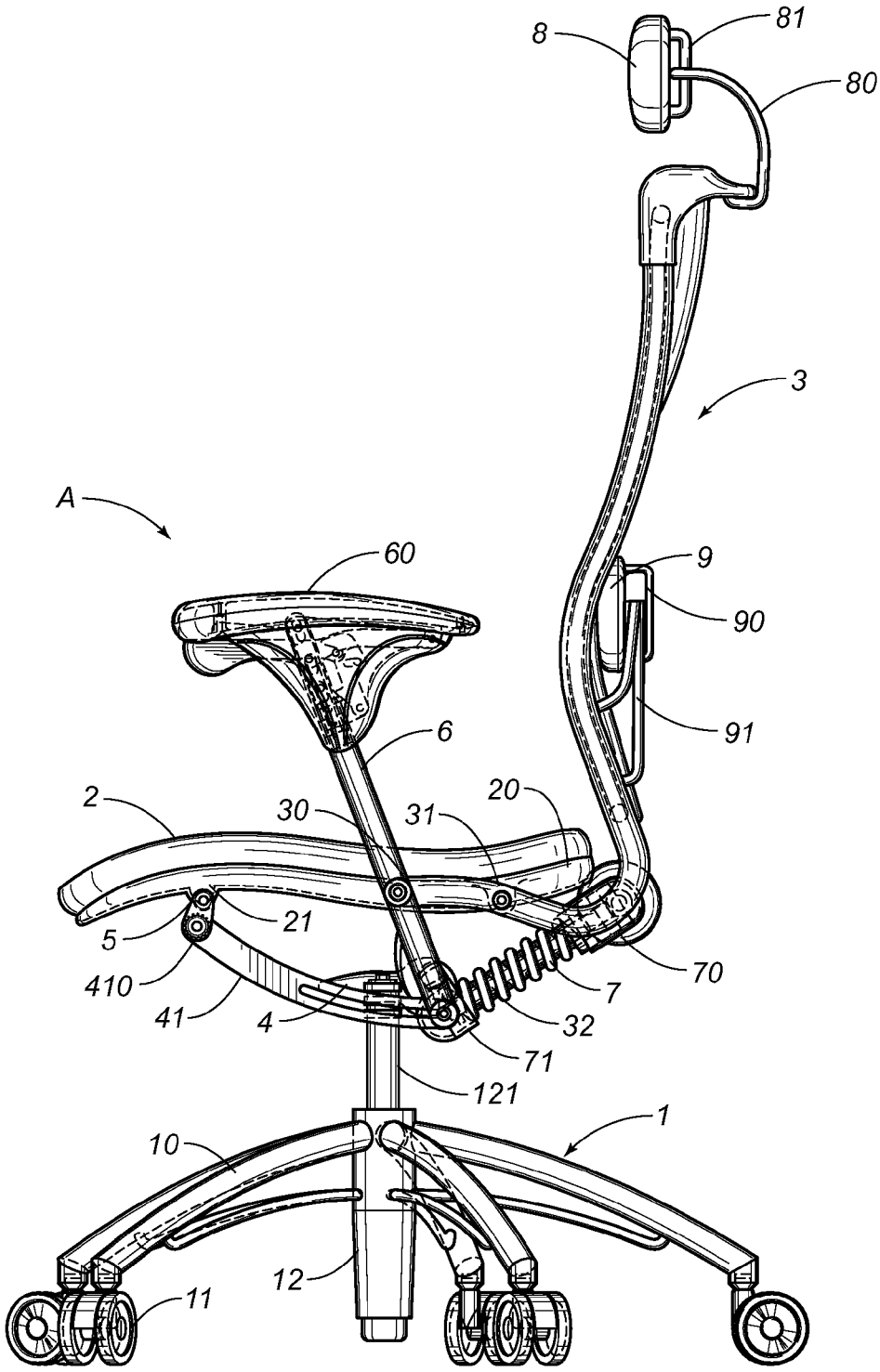
FIG. 1 is a side view of the office chair structure with the seat surface and the backrest in the rest position.
Figure 2:
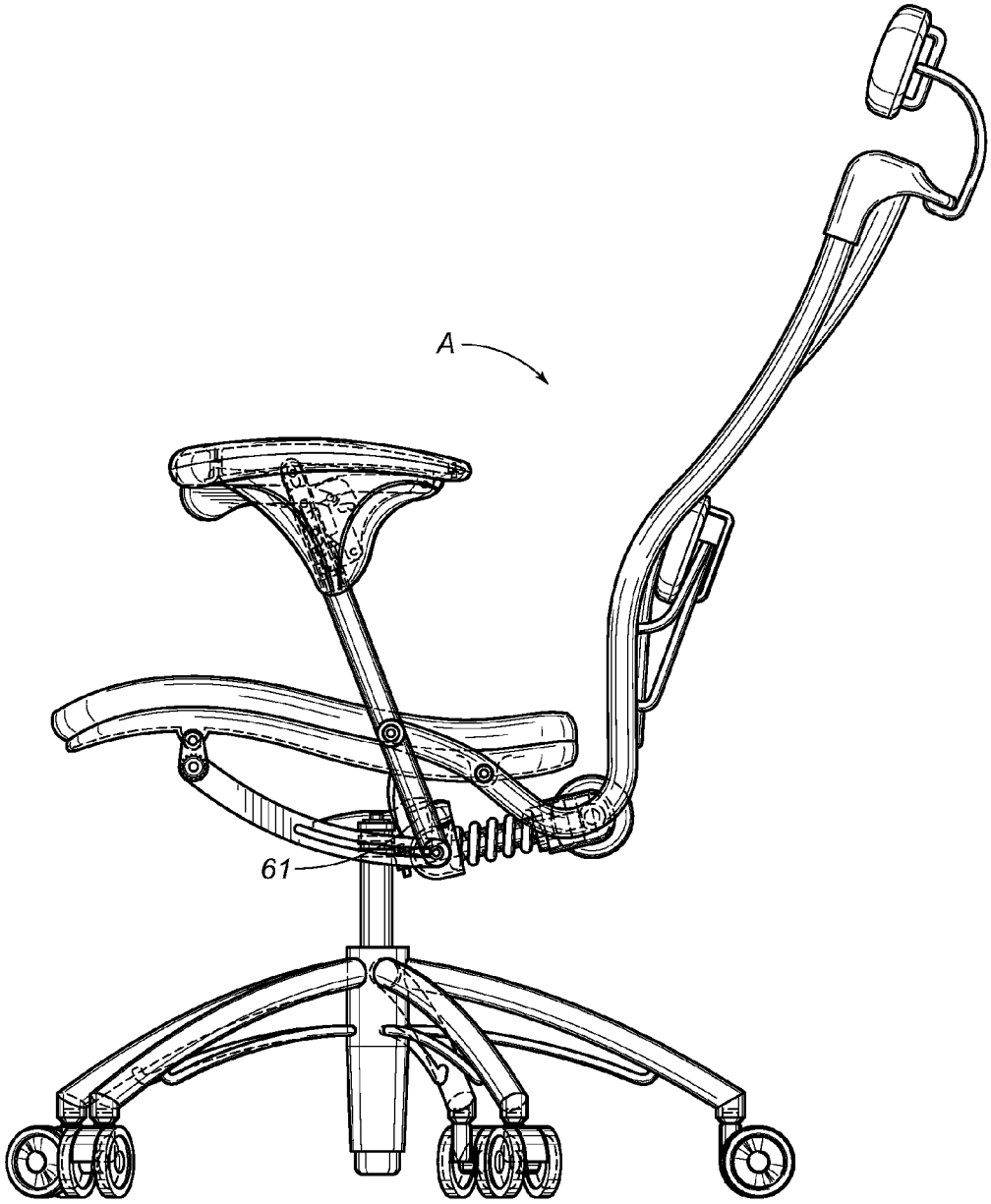
FIG. 2 is also a side view of the office chair structure represented with the seat flat and the backrest inclined.
Figure 3:
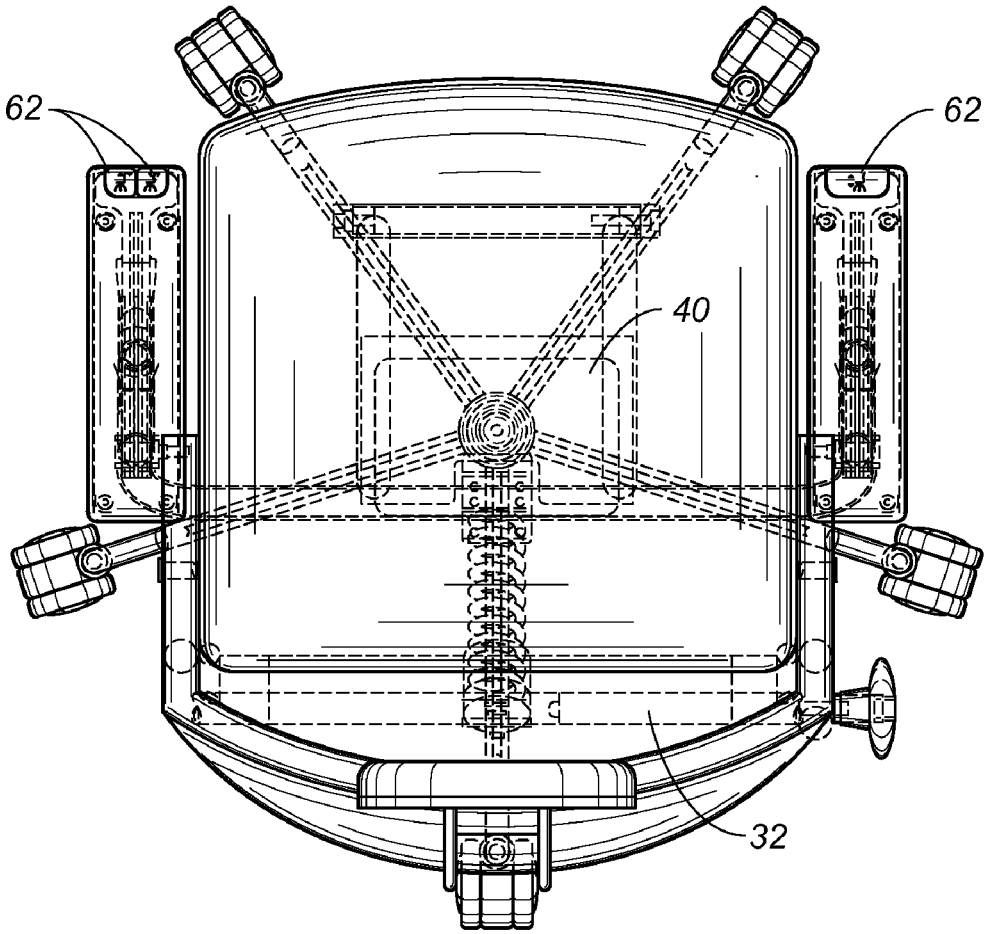
FIG. 3 is a plan view of the same office chair structure in the previous Figures.
Figure 4:
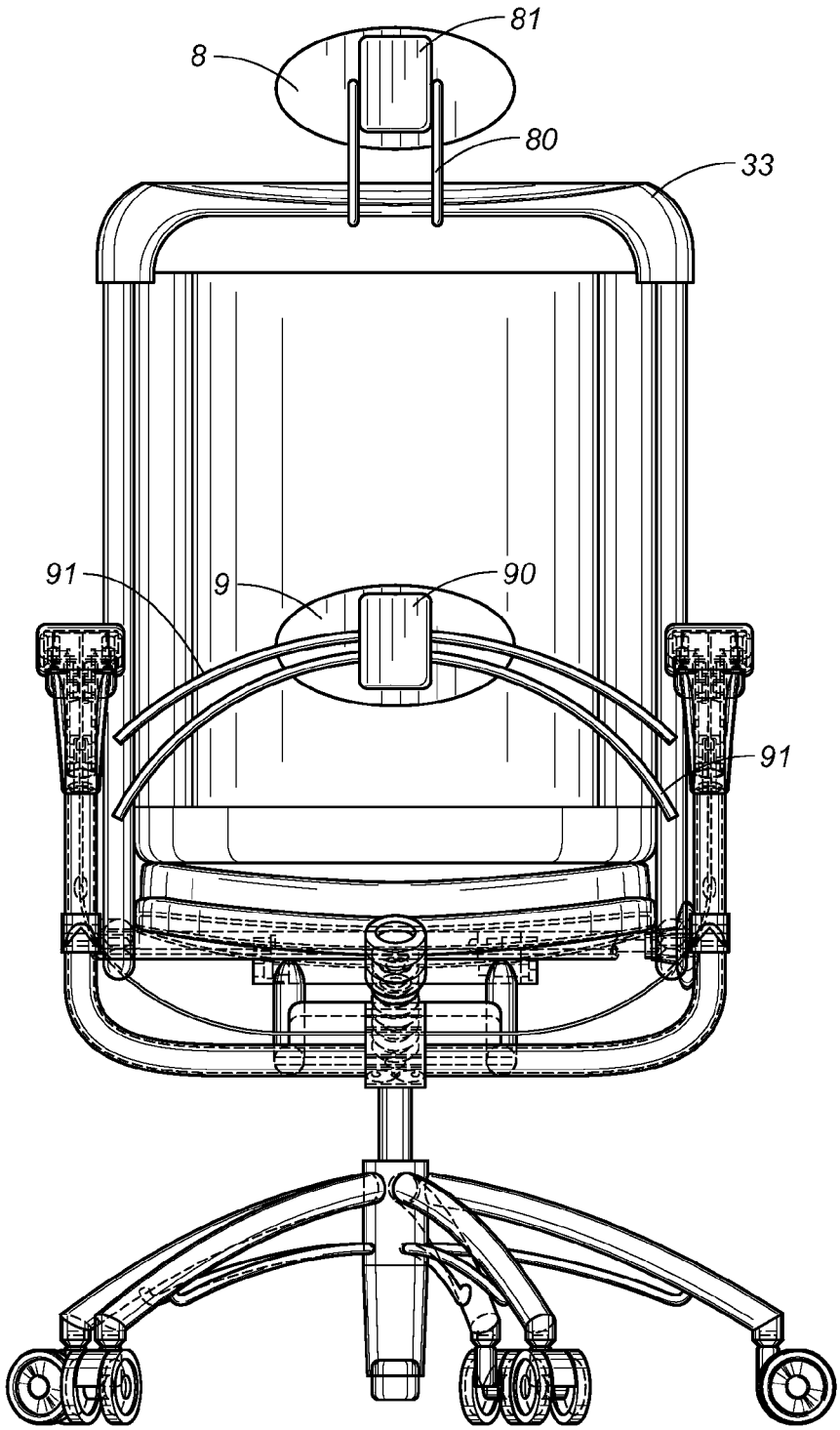
FIG. 4 is an elevation view, taken from the posterior side, of the office chair structure as in previous FIGS.

With reference also to the Figures, it is observed that an office arm-chair structure A is the type made up of a base 1 that supports a seat surface 2 positioned above and a backrest 3 reciprocally engaged to each other.

In this case, it is observed that the base 1 includes a plurality of spokes 10 arranged radially at the ends of each of which a rotating caster 11 is hinged. The opposite ends of each spoke 10 converge in correspondence with the lower part of a vertical column 12 that comprises a conventional gas cylinder whose shaft 121 is engaged at the top of the central support body 4.

In more detail, said central support body 4 includes a plate 40 provided with a hole with a conical ring opening, coaxially to which the top of the shaft 121 that can be actuated is to be butted. Said plate 40 disposes, cantilevered and outstretched towards the anterior part of the seat, of a pair of parallel arms 41 that present a slightly arched shape. In correspondence to the end 410 of each of said arms 41 a brace 5 is hinged, which is in turn pivoted in correspondence with a protuberance 21 that engages a corresponding transversal support element along the lower side of the seat surface 2.

Also said central support body 4 provides hinged from the opposite side with respect to the arms 41, the lower end 61 of a pair of stanchions 6, each of which supports on the top a corresponding shaped arm 60. In a position between the pivoting of the stanchion 6 to the central support body 4 and the shaped arm 60, the lower end 30 of the support frame of the backrest 3 is hinged by means each of the two sides, Also said backrest support frame 3 is of the L-shaped type and is fixed in 31 along the posterior part of the relative side 20 of the seat surface 2. In this way the curvilinear vertical portion of the backrest support frame 3 extends upwards. Furthermore, it is observed that a link, between the backrest support frame 3 and the central support body 4 is made up of a helicoidal compression spring 7 that serves the purpose of supporting the weight of the user during the oscillation of the chair. Said spring 7 is engaged at one end 71 to the transversal element 32 that joins the two sides of the support frame 3 while the opposite end 70 is engaged along the transverse and posterior part of the central support body 4.

In the vicinity of the posterior side of the backrest, a headrest 8 in the upper part and a lumbar support 9 in the lower part, both equipped with an adjusting device along the vertical axis, are respectively provided. In more detail, the headrest 8 includes two cantilevered arched support elements 80 that, with the lower ends, are perpendicularly engaged with respect to the top transversal element 33 that joins the two sides of the support frame of the backrest 3. Said arched support elements 80 engage the headrest 8 by means of the interposing of an adjustable guide device on the vertical axis 81. With reference to the lumbar support 9, it is observed that the latter by means of an guide device 90 adjustable along the vertical axis, is engaged in an intermediate position with respect to the two shaped arched elements 91 which, engaged with the ends, develop from one side to the other of the support frame 3 and in correspondence with the lower part of the latter.

To allow the lock-unlock function of the synchronized movement of the seat surface 2 and of the backrest 3, keys 62 are provided on the upper side of each of the two arm-rests 60, in proximity of the anterior edge, Operatively, the actuation of said keys 62, three in total, serve respectively to control the height adjustment of the chair (seat surface 2 and backrest 3) and the oscillation movement itself, for which there is one key for the unlock position and one for the locking position. More specifically, in the unlock position, the support frame of the backrest 3 rotates with the lower end 30 around the corresponding fulcrum, dragging with it, by means of the engagement 31 to the side 20, the posterior part of the seat surface 2. In this case it is understood that the spring 7 has the function of opposing the backward oscillation movement.

I claim:

1. An office chair apparatus comprising:

a seat;

an adjustable backrest having a support frame;

a swivelable movable base:

a height-adjustable column extending upwardly from said base, said column supporting said seat and said backrest thereon;

a headrest adjustably supported by said backrest, said backrest having an adjustable lumbar support thereon;

a central support body anchored to a top of said column along a vertical axis thereof, said seat being frontally connected to a corresponding anterior side of said central support body;

a pair of armrest stanchions having respective lower ends hingedly connected to a posterior side of said central support body, said pair of armrest stanchions being hingedly connected in a position intermediate said support frame of said backrest, said support frame of said backrest being hingedly connected at opposite sides thereof to a posterior portion of said seat;

a compressed spring interposed between said central support body and said support frame of said backrest so as to allow an oscillating movement between said backrest and said seat; and a locking means cooperative with said backrest and said seat so as to fix a position of said backrest relative to said seat and for selectively preventing against the oscillating movement therebetween, said central support body comprising:

a plate that is cantilevered and extends toward an anterior part of said seat; and a pair of parallel arms having an arched shape, each of said pair of parallel arms defining a hinged brace pivotally connected to said seat.

2. The office chair apparatus of claim 1, said pair of parallel arms of said central support body having an end hingedly connected respectively to said lower end of said pair of armrest stanchions.

3. The office chair apparatus of claim 1, said support frame of said backrest being L-shaped, said support frame of said backrest being fixed along respective sides of the posterior portion of said seat.

4. The office chair apparatus of claim 1, said compressed spring being a helicoidal compressed spring interposed between said support frame of said backrest and said central support body, said support frame having a transverse element joining sides of said support frame, one end of said helicoidal compressed spring engaged with said transverse element, said helicoidal compressed spring having a opposite end engaged along a transverse and posterior portion of said central support body.

5. The office chair of claim 1, said headrest having a pair of cantilevered support elements, said support frame of said backrest having sides joined by a top transverse element, said pair of cantilevered support elements having respective lower ends engaged perpendicularly to said top transverse element, said headrest having a guide structure interposed between said pair of cantilevered support elements so as to allow an adjustment of said headrest along a vertical axis, said lumbar support being adjustable along another vertical axis.

* * * * *